US006909428B2

(12) United States Patent
Su

(10) Patent No.: US 6,909,428 B2
(45) Date of Patent: Jun. 21, 2005

(54) SIGNAL CONVERTER DEVICE

(75) Inventor: Chi-Ming Su, Hsien (TW)

(73) Assignee: Acer Communications and Multimedia Inc., Taoyaun (TW)

( * ) Notice: Subject to any disclaimer, the term of this patent is extended or adjusted under 35 U.S.C. 154(b) by 330 days.

(21) Appl. No.: 10/000,565

(22) Filed: Oct. 23, 2001

(65) Prior Publication Data

US 2003/0020706 A1 Jan. 30, 2003

(30) Foreign Application Priority Data

Nov. 6, 2000 (TW) ..... 89123395 A

(51) Int. Cl.[7] ..... G09G 5/00; G09G 3/18; G09G 3/36

(52) U.S. Cl. ..... 345/213; 345/53; 345/99; 345/208

(58) Field of Search ..... 345/53, 87, 88, 345/94, 98–100, 204, 208, 213, 214, 501, 520, 561, 691

(56) References Cited

U.S. PATENT DOCUMENTS 4,335,403 A * 6/1982 Srivastava ..... 348/546
4,459,612 A * 7/1984 Shinkai et al. ..... 348/529
4,520,394 A * 5/1985 Kaneko ..... 348/546
4,974,081 A * 11/1990 Yokogawa ..... 348/542
4,999,707 A * 3/1991 Hirao et al. ..... 348/525
5,021,719 A * 6/1991 Arai et al. ..... 315/364
5,132,794 A * 7/1992 Okada et al. ..... 348/531
5,539,343 A * 7/1996 Yamashita et al. ..... 327/142
5,767,917 A * 6/1998 Gornstein et al. ..... 348/543
5,790,200 A * 8/1998 Tsujimoto et al. ..... 348/545
5,900,914 A * 5/1999 Niijima ..... 348/521

* cited by examiner

*Primary Examiner*—Bipin Shalwala
*Assistant Examiner*—Jeff Piziali
(74) *Attorney, Agent, or Firm*—Ladas & Parry LLP

(57) ABSTRACT

The present invention provides a device for signal transfer, which outputs a treatment signal relating to a vertical-horizontal composite sync signal of a monitor and an integrated signal of the vertical-horizontal composite sync signal. There is a plurality of logic circuits in the device of the present invention. The first logic circuit is provided for receiving the vertical-horizontal composite sync signal and the integrated signal, and outputs a high level signal when the voltage level of the vertical-horizontal composite sync signal transforms from the high level to the low level while the voltage level of the integrated signal is in the low level. The second logic circuit is connected to the first logic circuit and receives the vertical-horizontal composite sync signal and the signal outputted from the first logic circuit. The second logic circuit outputs a low level signal when the voltage level of the vertical-horizontal composite sync signal is transformed from the low level to the high level while the voltage level of the signal outputted from the first logic circuit is at the high level. The third logic circuit receives the vertical-horizontal composite sync signal and the signal outputted from the first logic circuit. The third logic circuit outputs a low level signal when the voltage level of the vertical-horizontal composite sync signal and the signal outputted from the first logic circuit is at the low level. The fourth logic circuit receives the signal outputted from the second logic circuit and the third logic circuit. The fourth logic circuit outputs a high level signal when the voltage level of the signals outputted from the second logic circuit and the third logic circuit are at the high level.

9 Claims, 5 Drawing Sheets

SIGNAL CONVERTER DEVICE

BACKGROUND OF THE INVENTION

Field of the Invention

The present invention relates in general to a signal converter device. In particular, the present invention relates to a signal converter device, which is used for dealing with the horizontal and vertical composite sync signal of a monitor.

In general, the color monitor of a personal computer is designed in RGB system. That is, the monitor generates the color pixels according to the R (the red video frequency signal), G (the green video frequency signal), B (the blue video frequency signal). Moreover, the monitor makes sure each frame's displaying mode of the pixels is based on the input sync signals.

The monitor displays the pixels by the combination of the continuous single frames. The frames are composed of a plurality of scanning lines. The operation of displaying the frames is used for scanning the scanning lines from the upper scanning line to the bottom scanning line. The vertical sync signal (written as V hereinafter) and the horizontal sync signal (written as H hereinafter) of the composite sync signal are used for vertical scanning the etch scanning line in turn and horizontal scanning the pixels of the scanning lines, respectively. Therefore, in order to display the pixels correctly, the monitor should be inputted the signals of R, G, B, V, H at least.

Normally, the generation of the video frequency signals R, G, B and sync signals V, H and the signals transmitting to the monitor are controlled by the video card or the display card in the computer system. Refer to FIG. 1, which depicts a part of structure of the computer system. The video card 10 is inset to the expansion of the computer system, and the video card 10 gets the displaying data from others parts of the computer system through the data bus, such as AGP or PCI. Then the video card generates the R,G, B,V,H signals according to the displaying data and sends the data to the monitors.

The video frequency signals R, G, B are outputted directly. However, the transmission of the sync signals may be done in different ways. One way is to use the separate sync signals. The vertical sync signal H and the horizontal sync signal V are inputted to the different terminals of the monitor, respectively. The other way uses the composite sync signals. The vertical sync signal H and the horizontal sync signal V are stacked to form the composite sync signal, then the composite sync signal is inputted to the specific terminals of the monitor, such as at the V terminal. At this time, the analog/digital converter circuit in the monitor will generate the clocks through the phase lock loop (written as PLL hereinafter) according to the composite sync signals.

The monitor must separate the composite sync signal from the vertical sync signal H and the horizontal sync signal V to display the pixels. The separating of the composite sync signal uses a specific circuit to integrate the composite sync signal and generates a shelter signal according to the polarization of the composite sync signal. Then, the shelter signal is inputted to the analog/digital converter circuit to turn off the PLL for interrupting the output of the clock.

However, there are many errors when dealing with the composite sync signal that may cause the display of a frame error.

Refer to FIG. 2, which depicts the timing of the composite sync signal HS and the shelter signal COAST-A of the prior art. To separate the composite sync signal correctly, the range of the shelter signal COAST-A must cover the range between the points B and K of the composite sync signal HS. Therefore, the clock outputted from the PLL will be blocked to prevent the abnormal pixels. However, because of the circuit characteristics and the delay of the signals, the shelter signal usually cannot cover the range between the B and K of the composite sync signal HS completely. When the range between the points B and C of the composite sync signal HS is not covered by the shelter signal COAST-A, the analog/digital converter circuit will keep supplying the clock in the period between the points B and C, and this situation will effect the performance of the display.

SUMMARY OF THE INVENTION

The object of the present invention is provided a signal converter device, which treats the composite sync signal in advance to modifying the defect of the signal, then outputs the modified composite sync signal to the monitor. Subsequently, the monitor generates the shelter signal according to the modified composite sync signal, and the shelter signal will cover the expected range of the modified composite sync signal. Therefore, the display of the abnormal pixels will be eliminated.

To achieve the above-mentioned objects, the present invention provides a device for signal transferring, which outputs a treatment signal relating to a vertical-horizontal composite sync signal of a monitor and an integrated signal of the vertical-horizontal composite sync signal. There is a plurality of logic circuits in the device of the present invention. The first logic circuit is provided for receiving the vertical-horizontal composite sync signal and the integrated signal, and outputs a high level signal when the voltage level of the vertical-horizontal composite sync signal transforms from the high level to the low level while the voltage level of the integrated signal is in the low level. The second logic circuit is connected to the first logic circuit and receives the vertical-horizontal composite sync signal and the signal outputted from the first logic circuit. The second logic circuit outputs a low level signal when the voltage level of the vertical-horizontal composite sync signal is transformed from the low level to the high level while the voltage level of the signal outputted from the first logic circuit is in the high level. The third logic circuit receives the vertical-horizontal composite sync signal and the signal outputted from the first logic circuit. The third logic circuit outputs a low level signal when the voltage level of the vertical-horizontal composite sync signal and the signal outputted from the first logic circuit is in the low level. The fourth logic circuit receives the signal outputted from the second logic circuit and the third logic circuit. The fourth logic circuit outputs a high level signal when the voltage level of the signals outputted from the second logic circuit and the third logic circuit are at the high level.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE PREFERRED EMBODIMENT

Figure 1:
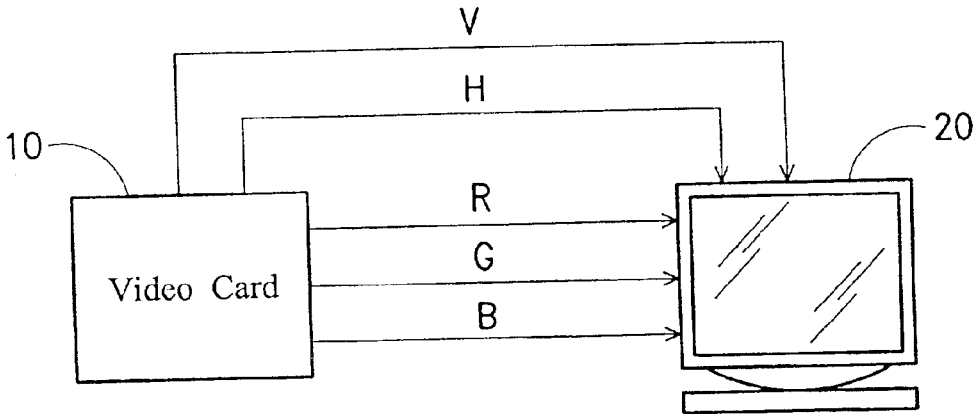
FIG. 1( PRIOR ART )
FIG. 1 depicts a part of structure of the computer system.
Figure 2:
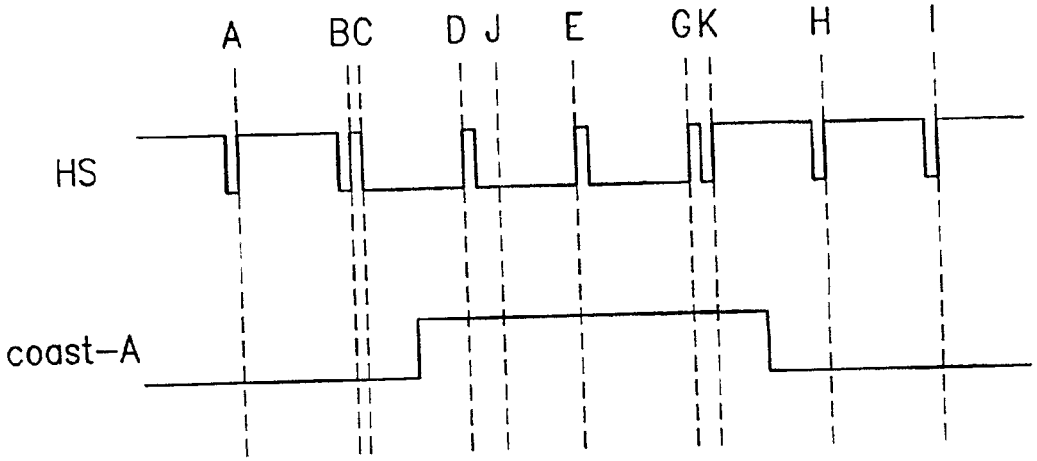
FIG. 2 ( PRIOR ART )
FIG. 2 depicts the timing of the composite sync signal HS and the shelter signal COAST-A of the prior art.
Figure 3:
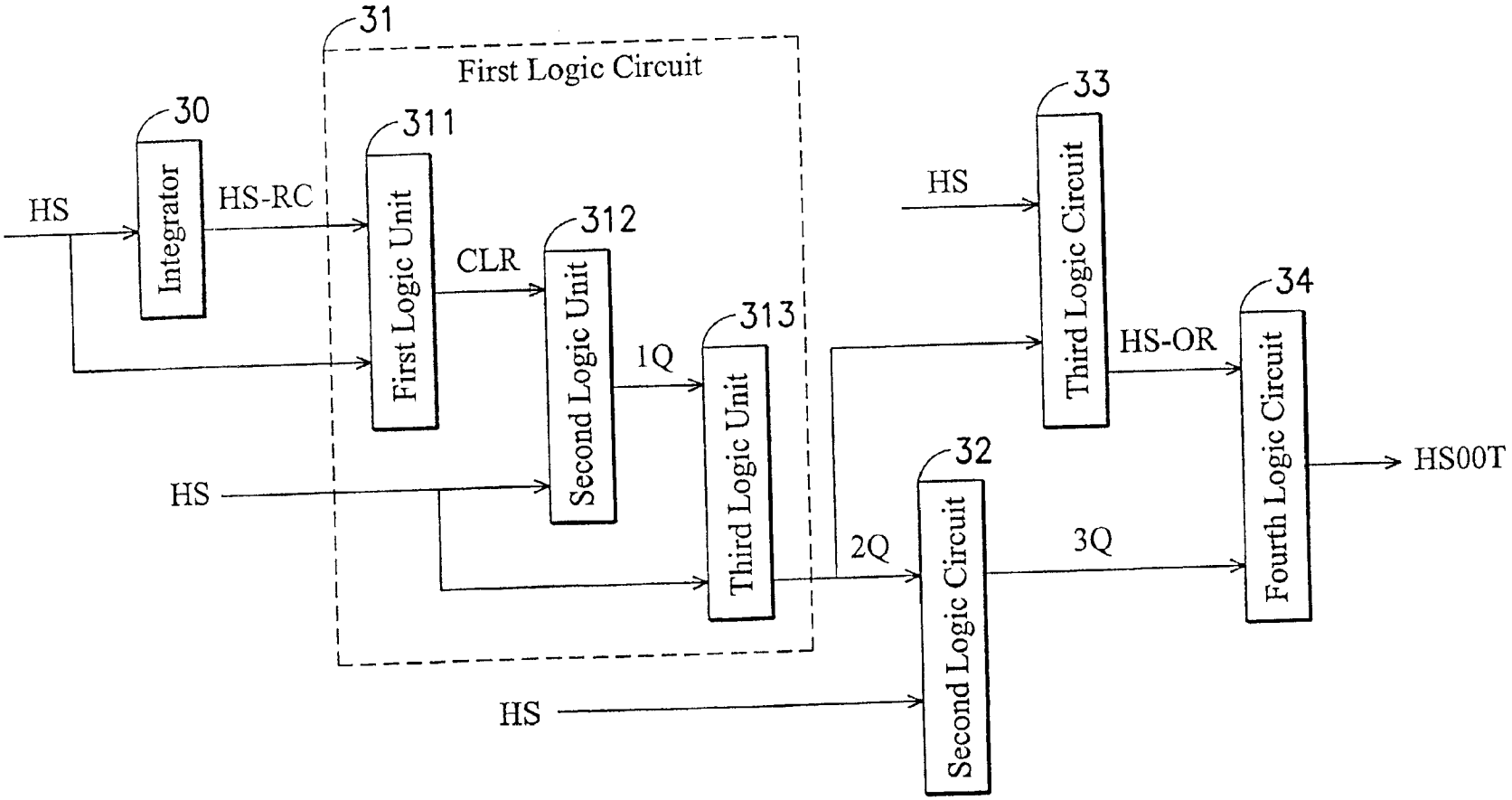
FIG. 3 depicts the circuit block diagram of the embodiment according to the present invention.

Refer to FIG. 3, which depicts the circuit block diagram of the embodiment according to the present invention.

The signal converter device of the embodiment according to the present invention is located between a video card and a monitor. The signal converter device outputs a treatment signal HSOOT relating to a vertical-horizontal composite sync signal HS of a monitor and an integrated signal HS-RC of the vertical-horizontal composite sync signal HS. In addition, the monitor of the embodiment according to the present invention is a liquid crystal display.

The structure of the signal converter device of the embodiment according to the present invention will be described below.

An integrator 30 is provided for integrating the vertical-horizontal composite sync signal HS to the integrated signal HS-RC. A first logic circuit 31 is provided for receiving the vertical-horizontal composite sync signal HS and the integrated signal HS-RC. When the voltage level of the vertical-horizontal composite sync signal HS is transformed from the high level to the low level while the voltage level of the integrated signal HS-RC is in the low level, the first logic circuit 31 outputs a high level signal. A second logic circuit 32 connecting to the first logic circuit 31 is provided for receiving the vertical-horizontal composite sync signal HS and the signal 2Q outputted from the first logic circuit 31. When the voltage level of the vertical-horizontal composite sync signal HS is transformed from the low level to the high level while the voltage level of the signal 2Q is in the high level, the second logic circuit 32 outputs a low level signal. A third logic circuit 33 is provided for receiving the vertical-horizontal composite sync signal HS and the signal 2Q outputted from the first logic circuit 31. When the voltage level of the vertical-horizontal composite sync signal HS and the signal 2Q outputted from the first logic circuit 31 is in the low level, the third logic circuit 33 outputs a low level signal. A fourth logic circuit 34 is provided for receiving the signals 3Q and HS-OR outputted from the second logic circuit 32 and the third logic circuit 33, respectively. When the voltage level of the signals outputted from the second logic circuit 32 and the third logic circuit 33 are in the high level, the fourth logic circuit outputs a high level signal.

Moreover, the first logic circuit 31 of the embodiment further comprises the following elements.

A first logic unit 311 is provided for receiving the vertical-horizontal composite sync signal HS and the integrated signal HS-RC. When the voltage level of the vertical-horizontal composite sync signal HS is transformed from the high level to the low level while the voltage level of the integrated signal HS-RC is in the low level, the first logic unit 311 outputs a low level signal. A second logic unit 312 is provided for receiving the vertical-horizontal composite sync signal HS and the signal CLR outputted from the first logic unit 311. When the voltage level of the vertical-horizontal composite sync signal HS transforms from the low level to the high level while the voltage level of the signal CLR is in the high level, the second logic unit 312 outputs a first specific signal, wherein the first specific signal is a square-wave having a first width. A third logic unit 313 is provided to receive the vertical-horizontal composite sync signal HS and the signal 1Q outputted from the second logic unit 312. When the voltage level of the vertical-horizontal composite sync signal HS transforms from the high level to the low level while the voltage level of the signal 1Q outputted from the second logic unit 312 is in the high level, the third logic unit 313 outputs a second specific signal to the second logic circuit 32, wherein the second specific signal is a square-wave having a second width. In addition, the first width and the second width are controlled by related RC-circuits, and the implement of the RC-circuits will be described later.

Figure 4:
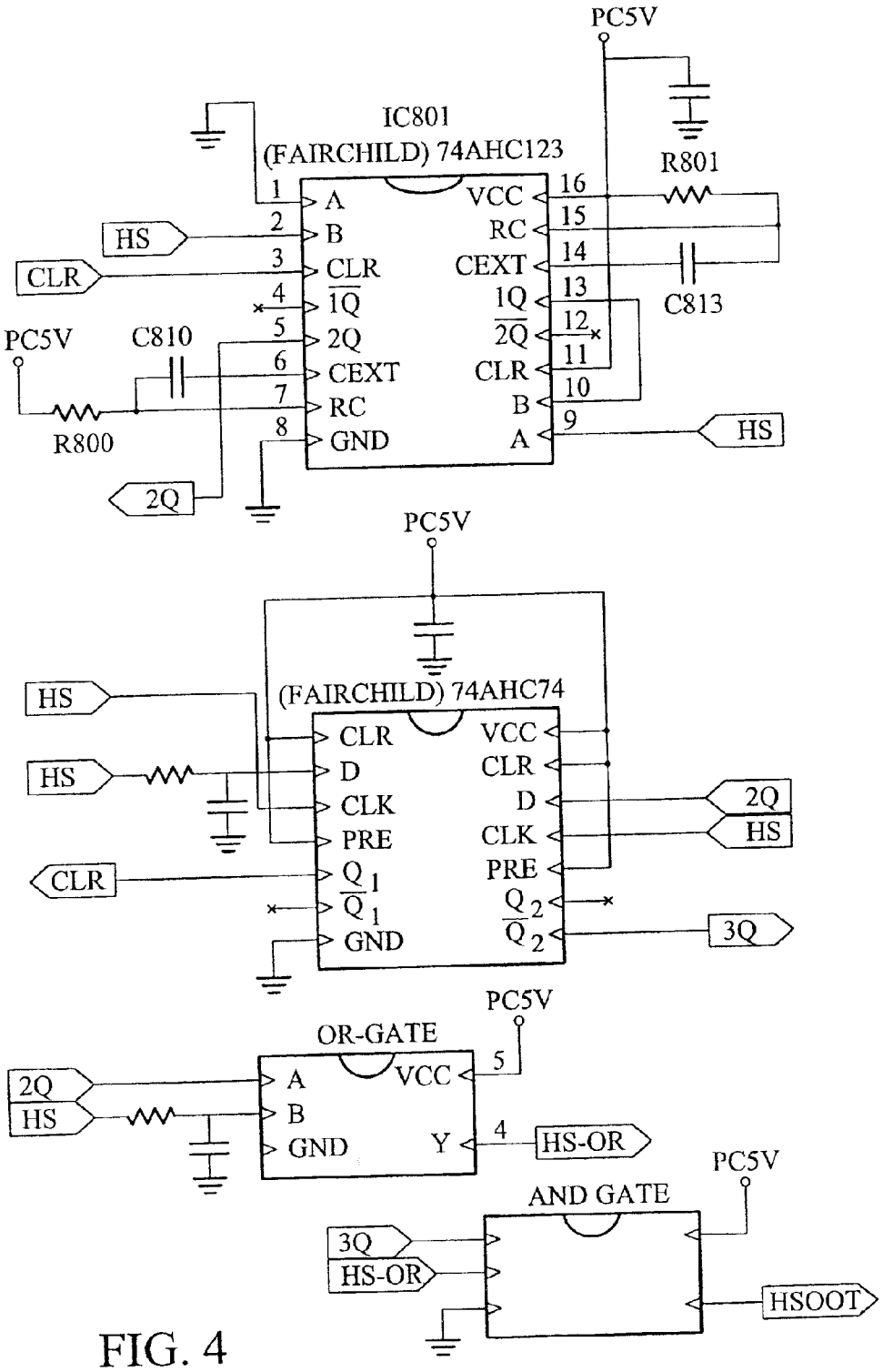
FIG. 4 depicts the detailed circuit diagram of the embodiment according to the present invention.

Refer to FIG. 4, which depicts the detailed circuit diagram of the embodiment according to the present invention. The content of FIG. 4 is about the serial numbers of each chip, and the connection of each element. In FIG. 4, the chip IC801 74AHC123 and the chip 74AHC74 are made by FAIRCHILD.

Figure 5:
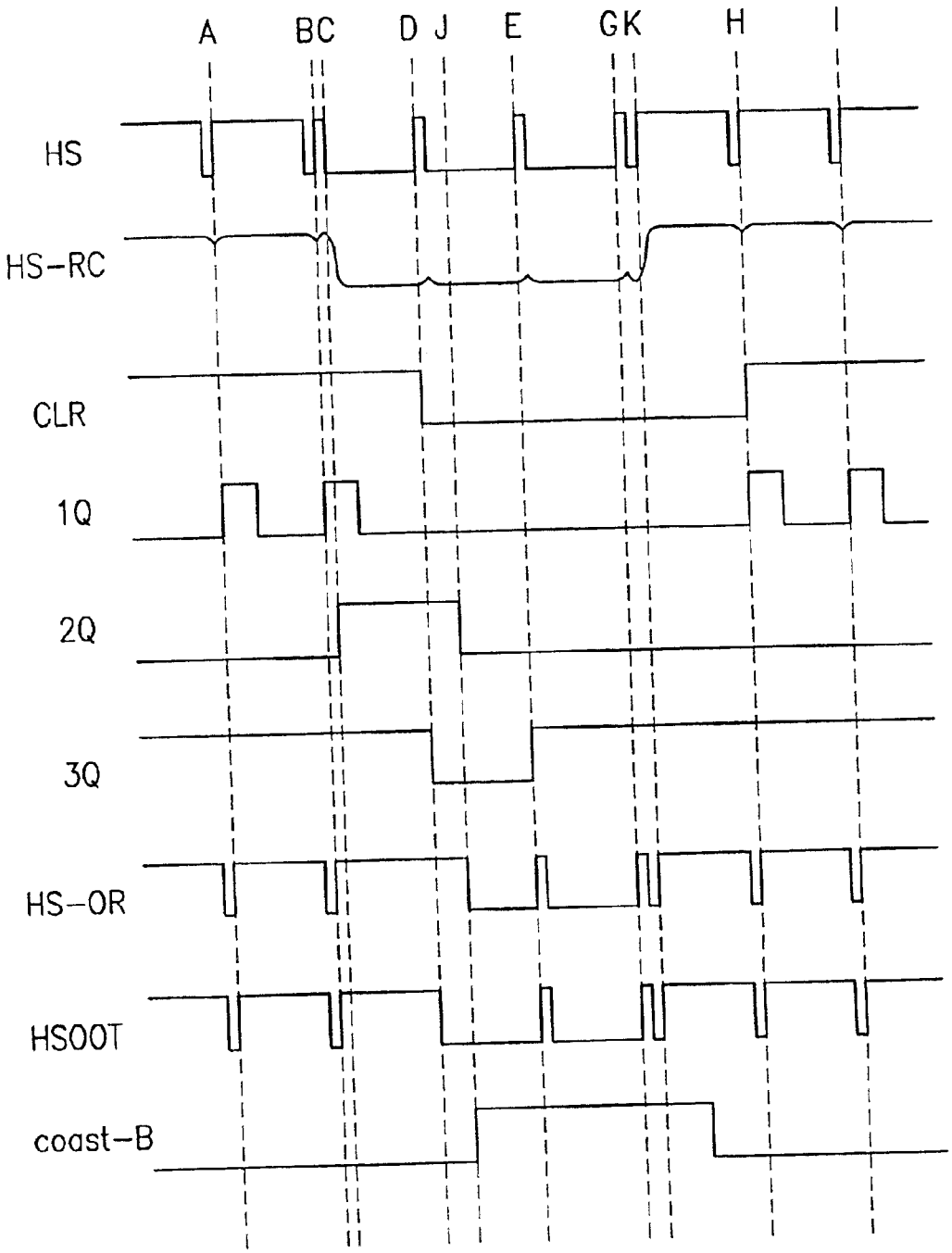
FIG. 5 depicts the timing of the embodiment according to the present invention.

Refer to FIG. 5, which depicts the timing of the embodiment according to the present invention.

First, the signal HS-RC is generated by an integrator 30 integrating a vertical-horizontal composite sync signal HS. Subsequently, signals HS and HS-RC are inputted to the first logic unit 311, then the first logic unit 311 generates the signal CLR according to the true table (1) described below.

| INPUT | | OUTPUT | |
|---|---|---|---|
| CLK | D | Q | $\overline{Q}$ |
| ↑ | H | H | L |
| ↑ | L | L | H |

At point B, the signal HS is raised to the high level, and the signal HS-RC is in the high level, so that the output Q is in the high level.

At point D, the signal HS is raised to the high level, and the signal HS-RC is in the low level, so that the output Q is in the low level.

At point G, the signal HS is raised to the high level, and the signal HS-RC is at the low level, so that the output Q is at the low level.

At point H, the signal HS is raised to the high level, and the signal HS-RC is at the high level, so that the output Q is at the high level.

Subsequently, the signals HS and CLR are inputted to the second logic unit 312, which is Monostable, and the second logic unit 312 outputs the signal 1Q according to the true table (2) as described below.

| INPUT | | | OUTPUT | |
|---|---|---|---|---|
| CLEAR | A | B | Q | $\overline{Q}$ |
| H | L | ↑ | ⎍ | ⎏ |
| H | ↓ | H | ⎍ | ⎏ |
| L | X | X | L | H |

At point A, the signal HS is raised to the high level, and the signal CLR is in the high level, so that the waveform of the signal outputted from output Q is like ⎍

At point D, the signal HS is raised to the high level, and the signal CLR is at the low level, so that the waveform of the signal outputted from output Q is like At point H, the signal HS is raised to the high level, and the signal CLR is at the high level, so that the waveform of the signal outputted from output Q is like It is noted that the pulse-width of the signal 1Q is larger than the width of the range between point B and C to provide enough time to trigger the signal 2Q. In addition, the pulse-width of the signal 1Q is controlled by the resistor R801 and the capacitor C813.

Subsequently, the signals HS and 1Q are inputted the third logic unit 313, which is Monostable, and the third logic unit 313 outputs the signal 2Q according to the true table (2) as described above.

At point C, the signal HS is dropped to the low level, and the signal 1Q is at the high level, so that the waveform of the signal outputted from output Q is like It is noted that the pulse-width of the signal 2Q is larger than the width of the range between point C and D to provide enough time to trigger the signal 3Q. In addition, the pulse-width of the signal 2Q is controlled by the resistor R800 and the capacitor C810.

Subsequently, the signals HS and 2Q are inputted to the second logic circuit 32, and the second logic unit 312 outputs the signal 3Q according to the true table (3) as described below.

| INPUT | | OUTPUT | |
|---|---|---|---|
| CLK | D | Q | $\overline{Q}$ |
| ↑ | H | H | L |
| ↑ | L | L | H |

At point B, the signal HS is raised to the high level, and the signal 2Q is in the low level, so th-at the output signal of $\overline{Q}$ is at the high level.

At point D, the signal HS is raised to the high level, and the signal 2Q is at the high level, so that the output signal of $\overline{Q}$ is at the low level.

At point E, the signal HS is raised to the high level, and the signal 2Q is at the low level, so that the output signal of $\overline{Q}$ is at the high level.

Then, the signals HS and 2Q are inputted to the third logic circuit 33, which is an OR-gate, to generate the signal HS-OR.

Finally, the signals 3Q and HS-OR are inputted to the fourth logic circuit 34, which is an AND-gate, to generate the signal HSOOT. That is, the signal HSOOT will cause the operation of the monitor normally.

Figure 6:
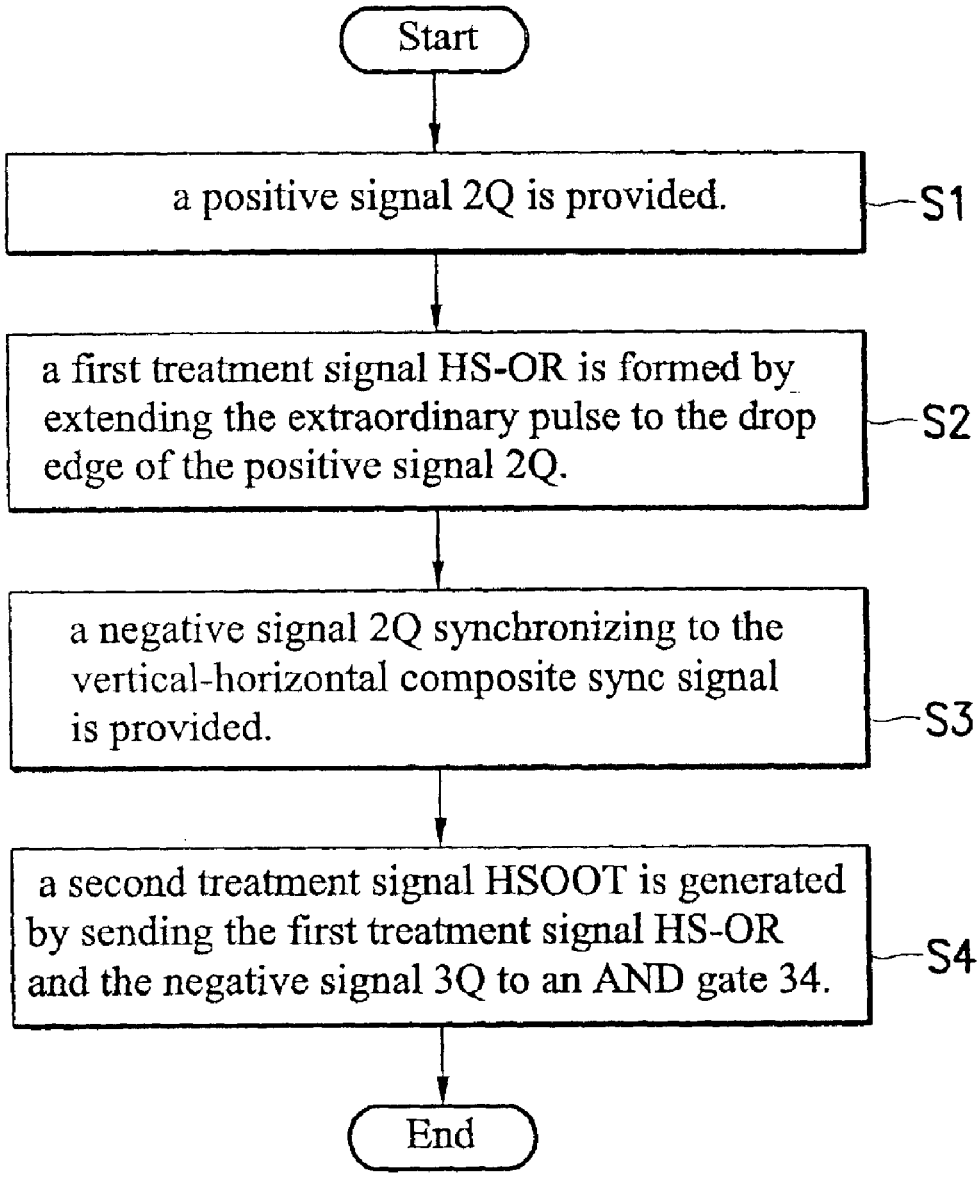
FIG. 6 depicts the flow chart of the signal transferring of the embodiment according to the present invention.

Refer to FIG. 6, which depicts the flow chart of the signal transferring of the embodiment according to the present invention. The labels are referred to FIG. 5. The operation of the signal transferring of the embodiment according to the present invention is described below.

Step S1: a positive signal 2Q is provided which has a first width between point C and J. Here, a RC-circuit composed of the capacitor C810 and the resistor R800 control the first width.

Step S2: an extraordinary pulse of the vertical-horizontal composite sync signal is detected, the range of the extraordinary pulse is from the point B to the point C of the HS in FIG. 5, then a first treatment signal HS-OR is formed by extending the extraordinary pulse to the drop edge (point J) of the positive signal 2Q.

Step S3: a negative signal 2Q synchronizing to the vertical-horizontal composite sync signal is provided.

Step S4: a second treatment signal HSOOT is generated by sending the first treatment signal HS-OR and the negative signal 3Q to an AND gate 34(referring to FIG. 3).

Finally, the treated second treatment signal HSOOT is inputted to the anolog/digital converter circuit of the monitor. Thus, the display of the monitor will be fine.

The range between point B and C of the signal HS is the extraordinary pulse, which is not expected. When the signal is inputted to the analog/digital converter circuit of the monitor, then the signal COAST-A is actived after the point C. It will cause the timing problems of the operation of the analog/digital converter circuit. Moreover, it will cause the display of the monitor to become crooked.

The circuit of the embodiment of the present detects the extraordinary pulse in the vertical-horizontal composite sync signal and modefies the extraordinary pulse, therefore, the actived time of the signal COAST-B will cover the range between the points E and K of the signal HSOOT to make the display performance of the monitor correctly.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and forthwith various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A device for signal transferring, which outputs a treatment signal relating to a vertical-horizontal composite sync signal of a monitor and an integrated signal of the vertical-horizontal composite sync signal, comprising:

a first logic circuit, which receives the vertical-horizontal composite sync signal and the integrated signal, the first logic circuit outputs a high level signal when the voltage level of the vertical-horizontal composite sync signal is transformed from the high level to the low level while the voltage level of the integrated signal is in the low level;

a second logic circuit connected to the first logic circuit, which receives the vertical-horizontal composite sync signal and the signal outputted from the first logic circuit, the second logic circuit outputs a low level signal when the voltage level of the vertical-horizontal composite sync signal that is transformed from the low level to the high level while the voltage level of the signal outputted from the first logic circuit is in the high level;

a third logic circuit, which receives the vertical-horizontal composite sync signal and the signal outputted from the first logic circuit, the third logic circuit outputs a low level signal when the voltage level of the vertical-horizontal composite sync signal and the signal outputted from the first logic circuit is at the low level; and a fourth logic circuit, which receives the signal outputted from the second logic circuit and the third logic circuit, the fourth logic circuit outputs a high level signal when the voltage level of the signals outputted from the second logic circuit and the third logic circuit are at the high level.

2. The device as claimed in claim 1, further comprising an integrator for integrating the vertical-horizontal composite sync signal to the integrated signal.

3. The device as claimed in claim 2, wherein the first logic circuit further comprising:

a first logic element, which receives the vertical-horizontal composite sync signal and the integrated signal, the first logic unit outputs a low level signal when the voltage level of the vertical-horizontal composite sync signal is transformed from the high level to the low level while the voltage level of the integrated signal is at the low level;

a second logic element, which receives the vertical-horizontal composite sync signal and the signal outputted from the first logic element, the second logic unit outputs a first specific signal when the voltage level of the vertical-horizontal composite sync signal is transformed from the low level to the high level while the voltage level of the signal outputted from the first logic unit is at the high level; and a third logic element, which receives the vertical-horizontal composite sync signal and the signal outputted from the second logic element, the third logic unit outputs a second specific signal to the second logic circuit when the voltage level of the vertical-horizontal composite sync signal is transformed from the high level to the low level while the voltage level of the signal outputted from the second logic unit is at the high level.

4. The device as claimed in claim 3, wherein the first specific signal is a square-wave having a first width.

5. The device as claimed in claim 4, wherein the second specific signal is a square-wave having a second width.

6. The device as claimed in claim 5, wherein the first width and the second width are controlled by related RC-circuits.

7. The device as claimed in claim 6, wherein the third logic circuit is an OR-gate.

8. The device as claimed in claim 7, wherein the fourth logic circuit is an AND-gate.

9. The device as claimed in claim 2, wherein the integrator is a RC-integrator.

* * * * *